US007920095B2

(12) United States Patent
Wei

(10) Patent No.: US 7,920,095 B2
(45) Date of Patent: Apr. 5, 2011

(54) THREE-DIMENSIONAL MULTI-FREQUENCY ANTENNA

(75) Inventor: Shen-Pin Wei, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 697 days.

(21) Appl. No.: 11/845,089

(22) Filed: Aug. 26, 2007

(65) Prior Publication Data

US 2009/0033557 A1 Feb. 5, 2009

(30) Foreign Application Priority Data

Jul. 31, 2007 (TW) ..... 96128114 A

(51) Int. Cl.
*H01Q 5/00* (2006.01)

(52) U.S. Cl. ..... 343/700 MS; 343/703; 343/749

(58) Field of Classification Search ..... 343/700 MS, 343/702, 781 CA, 754, 781 P, 840, 781 R, 343/785, 175, 802, 725, 790, 752, 742, 780, 343/749, 708, 727, 703, 729; 342/379, 352; 340/572.2; 333/139
See application file for complete search history.

(56) References Cited

U.S. PATENT DOCUMENTS

| | | | | |
|---|---|---|---|---|
| 7,170,464 | B2 | 1/2007 | Tang et al. | |
| 2007/0115200 | A1 * | 5/2007 | Ishimiya | 343/803 |
| 2008/0122717 | A1 * | 5/2008 | Su et al. | 343/787 |

OTHER PUBLICATIONS

K. L. Wong, L. C. Chou, and C. M. Su, "Dual-Band Flat-Plate Antenna With a Shorted Parasitic Element for Laptop Applications," IEEE Trans. Antennas Propagat., vol. 53, No. 1, pp. 539-544, Jan. 2005.

* cited by examiner

*Primary Examiner* — Douglas W Owens
*Assistant Examiner* — Jae K Kim
(74) *Attorney, Agent, or Firm* — Winston Hsu; Scott Margo

(57) ABSTRACT

A three-dimensional multi-frequency antenna includes a substrate; a shorting wall vertically formed on a first edge of the substrate; a radiation element including a first radiator corresponding to a first resonance frequency band, and a second radiator corresponding to a second resonance frequency band, the first radiator and the second radiator capable of generating a frequency-multiplying third resonance frequency extending toward opposite directions; and a connection element, for connecting the shorting wall and the radiation element, separated from a second edge of the substrate by a gap; wherein the width of the radiation element and the gap conforms to a specific ratio.

20 Claims, 12 Drawing Sheets

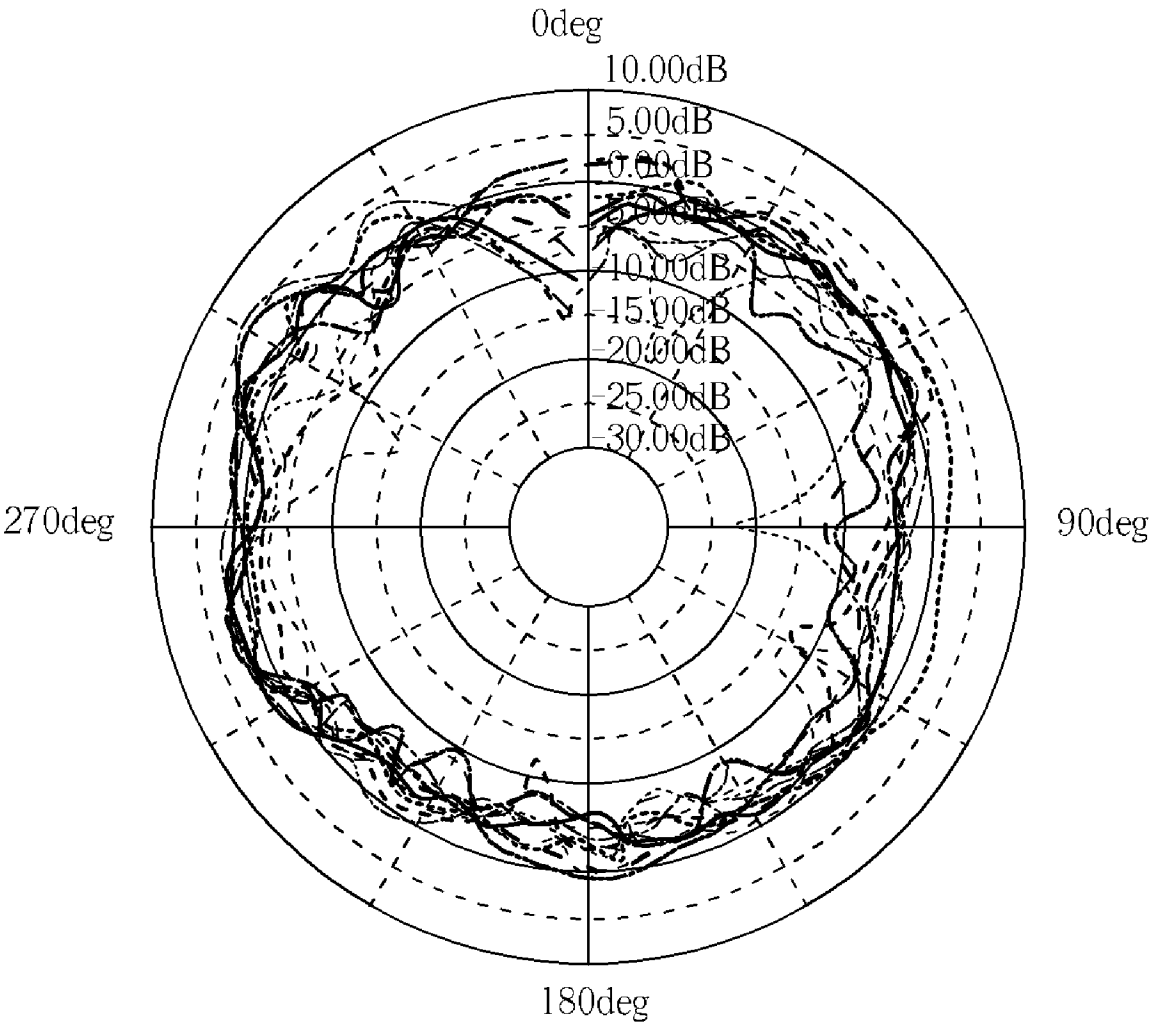
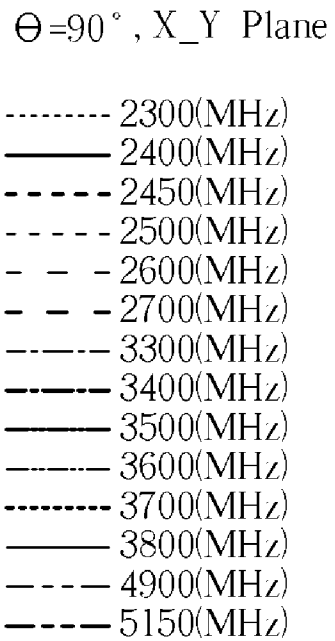
Fig. 5

| Layer | Max value | Position | Min value | Position | Average | Standard deviation |
|---|---|---|---|---|---|---|
| 2300 (MHz) | 4.81 dB | 297.00 deg | -12.03 dB | 0.00 deg | -0.18 dB | 3.16 |
| 2400 (MHz) | 5.55 dB | 300.00 deg | -10.63 dB | 354.00 deg | -0.76 dB | 3.22 |
| 2450 (MHz) | 4.01 dB | 297.00 deg | -5.93 dB | 18.00 deg | -1.11 dB | 2.60 |
| 2500 (MHz) | 3.82 dB | 300.00 deg | -13.00 dB | 90.00 deg | -2.01 dB | 3.61 |
| 2600 (MHz) | 4.65 dB | 297.00 deg | -21.13 dB | 90.00 deg | -1.74 dB | 4.83 |
| 2700 (MHz) | 5.03 dB | 297.00 deg | -11.81 dB | 348.00 deg | -2.25 dB | 4.15 |
| 3300 (MHz) | 0.70 dB | 219.00 deg | -8.39 dB | 150.00 deg | -2.27 dB | 1.75 |
| 3400 (MHz) | 1.00 dB | 249.00 deg | -8.72 dB | 153.00 deg | -2.30 dB | 2.10 |
| 3500 (MHz) | 0.60 dB | 246.00 deg | -13.07 dB | 93.00 deg | -2.57 dB | 2.95 |
| 3600 (MHz) | 1.37 dB | 12.00 deg | -9.67 dB | 99.00 deg | -2.43 dB | 2.87 |
| 3700 (MHz) | 2.54 dB | 6.00 deg | -13.09 dB | 120.00 deg | -2.79 dB | 3.34 |
| 3800 (MHz) | 2.32 dB | 33.00 deg | -15.66 dB | 291.00 deg | -2.89 dB | 3.78 |
| 4900 (MHz) | 0.49 dB | 258.00 deg | -19.19 dB | 21.00 deg | -3.90 dB | 3.05 |
| 5150 (MHz) | 3.40 dB | 327.00 deg | -11.76 dB | 357.00 deg | -2.10 dB | 2.93 |
| 5350 (MHz) | 3.73 dB | 327.00 deg | -9.54 dB | 351.00 deg | -1.93 dB | 2.72 |
| 5470 (MHz) | 3.52 dB | 327.00 deg | -8.41 dB | 351.00 deg | -1.94 dB | 2.37 |
| 5647.5 (MHz) | 2.25 dB | 327.00 deg | -7.97 dB | 192.00 deg | -2.50 dB | 2.42 |
| 5825 (MHz) | 3.20 dB | 252.00 deg | -15.35 dB | 357.00 deg | -3.12 dB | 3.31 |
| 5875 (MHz) | 2.63 dB | 252.00 deg | -16.34 dB | 354.00 deg | -3.76 dB | 3.59 |

Fig. 6

THREE-DIMENSIONAL MULTI-FREQUENCY ANTENNA

BACKGROUND OF THE INVENTION

1. Field of the Invention

The invention relates to a three-dimensional multi-frequency antenna, and more particularly, to a three-dimensional multi-frequency antenna capable of being applied in various wireless communications networks.

2. Description of the Prior Art

An electronic product with wireless communications functions, such as a notebook computer, can utilize a built-in antenna to access wireless communications networks, which carry information by radio waves. With regard to different wireless communications systems, the operating frequencies are also different, for example, operating frequency bands of a wireless fidelity (Wi-Fi) network is about 2.4 GHz~2.4835 GHz and 4.9 GHz~5.875 GHz, an operating frequency band of a Bluetooth network is about 2.402 GHz~2.480 GHz, operating frequency bands of a worldwide interoperability for microwave access (WiMAX) network is about 2.3 GHz~2.69 GHz, 3.3 GHz~3.8 GHz and 5.25 GHz~5.85 GHz, an operating frequency band of a wideband code division multiple access (WCDMA) network is about 1850 MHz~2025 MHz, an operating frequency band of a global system for mobile communications 1900 (GSM 1900) network is about 1850 MHz~1990 MHz, and an operating frequency band of an international mobile telecommunications-2000 (IMT-2000) network is about 1920 MHz~2170 MHz. Therefore, in order to help users more easily access various wireless communications networks, an ideal antenna should be able to cover operating frequency bands demanded by the above mentioned wireless communications networks. Furthermore, in order to cope with current ministration trends of portable electronic devices, like notebook computers, antenna sizes should be designed as small as possible.

SUMMARY OF THE INVENTION

It is therefore a primary objective of the present invention to provide a three-dimensional multi-frequency antenna.

The present invention discloses a three-dimensional multi-frequency antenna. The three-dimensional multi-frequency antenna comprises a substrate; a shorting wall, coupled to a first side edge of the substrate; a radiation element comprising a first radiator having a first sheet metal and a second sheet metal, and a second radiator having a third sheet metal and a fourth sheet metal, the first radiator and the second radiator extending toward opposite directions; and a connection element having a first end coupled to the shorting wall and a second end coupled between the first radiator and the second radiator of the radiation element, the connection element and a second side edge of the substrate having a spacing interval; wherein a width of the radiation element and the spacing interval conform to a ratio.

The present invention further discloses a three-dimensional multi-frequency antenna. The three-dimensional multi-frequency antenna comprises a substrate formed on a first plane; a shorting wall formed on a second plane, a side edge of the shorting wall coupled to a first side edge of the substrate; a radiation element comprising a first radiator, corresponding to a first resonance frequency band, having a first sheet metal formed on a third plane and a second sheet metal paralleled with the first plane, and a second radiator, corresponding to a second resonance frequency band, having a third sheet metal formed on the third plane and a fourth sheet metal paralleled with the first plane; and a connection element having a first end coupled to the side edge of the shorting wall and a second end coupled to the radiation element.

The present invention further discloses a three-dimensional multi-frequency antenna. The three-dimensional multi-frequency antenna comprises a substrate; a shorting wall coupled to a first side edge of the substrate; a radiation element comprising a first radiator having at least a bend and a second radiator having at least a bend, the first radiator and the second radiator extending toward opposite directions; and a connection element having a first end coupled to the shorting wall and a second end coupled between the first radiator and the second radiator of the radiation element, the connection element and a second side edge of the substrate having a spacing interval.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 5 is a schematic diagram of a radiation pattern of the multi-frequency antenna according to the present invention.

FIG. 6 is a schematic diagram of a measurement result of average gain of the multi-frequency antenna according to the present invention.

DETAILED DESCRIPTION

Figure 1:
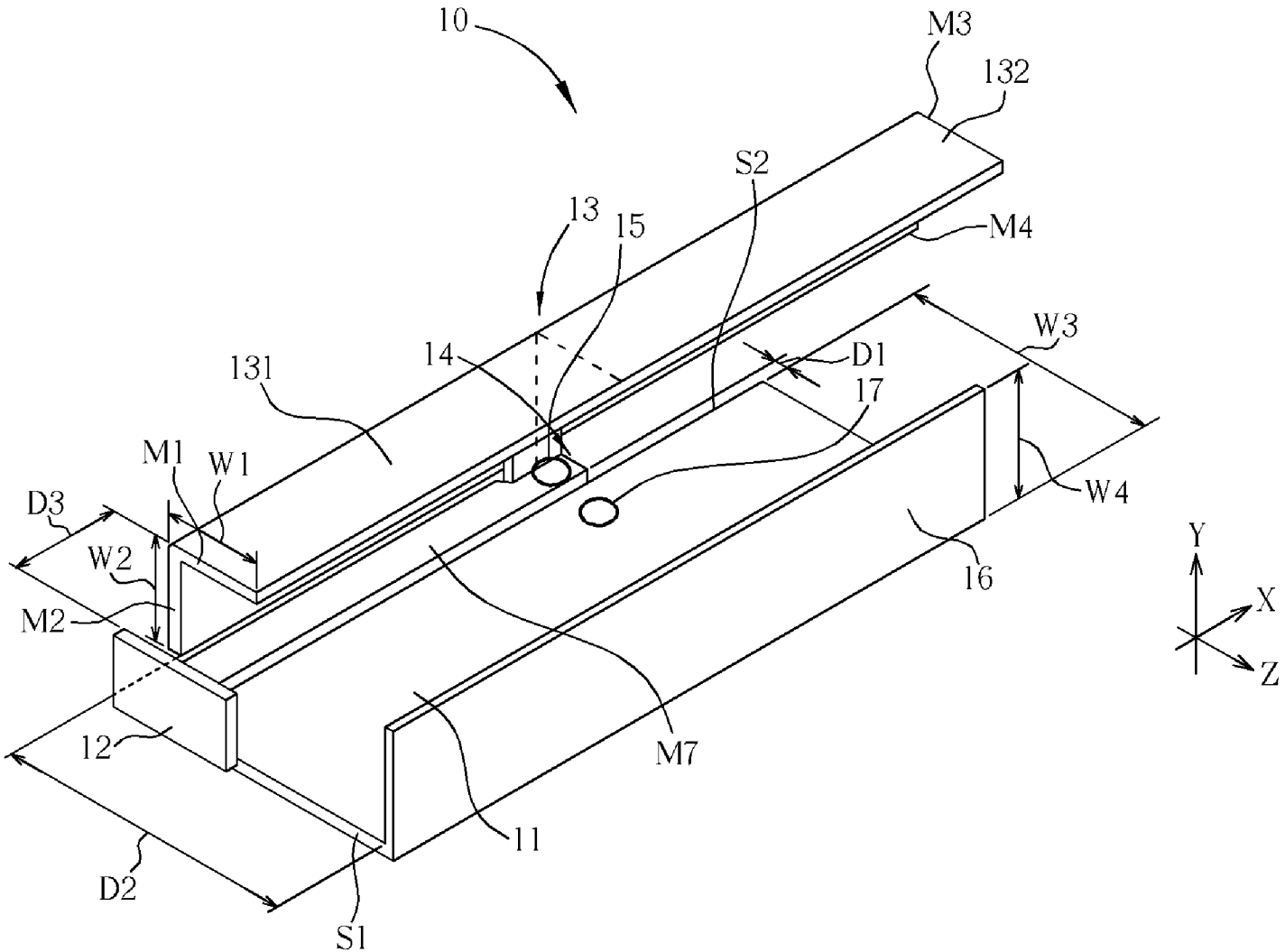
FIG. 1 is a three-dimensional diagram of a three-dimensional multi-frequency antenna according to an embodiment of the present invention.
Figure 2:
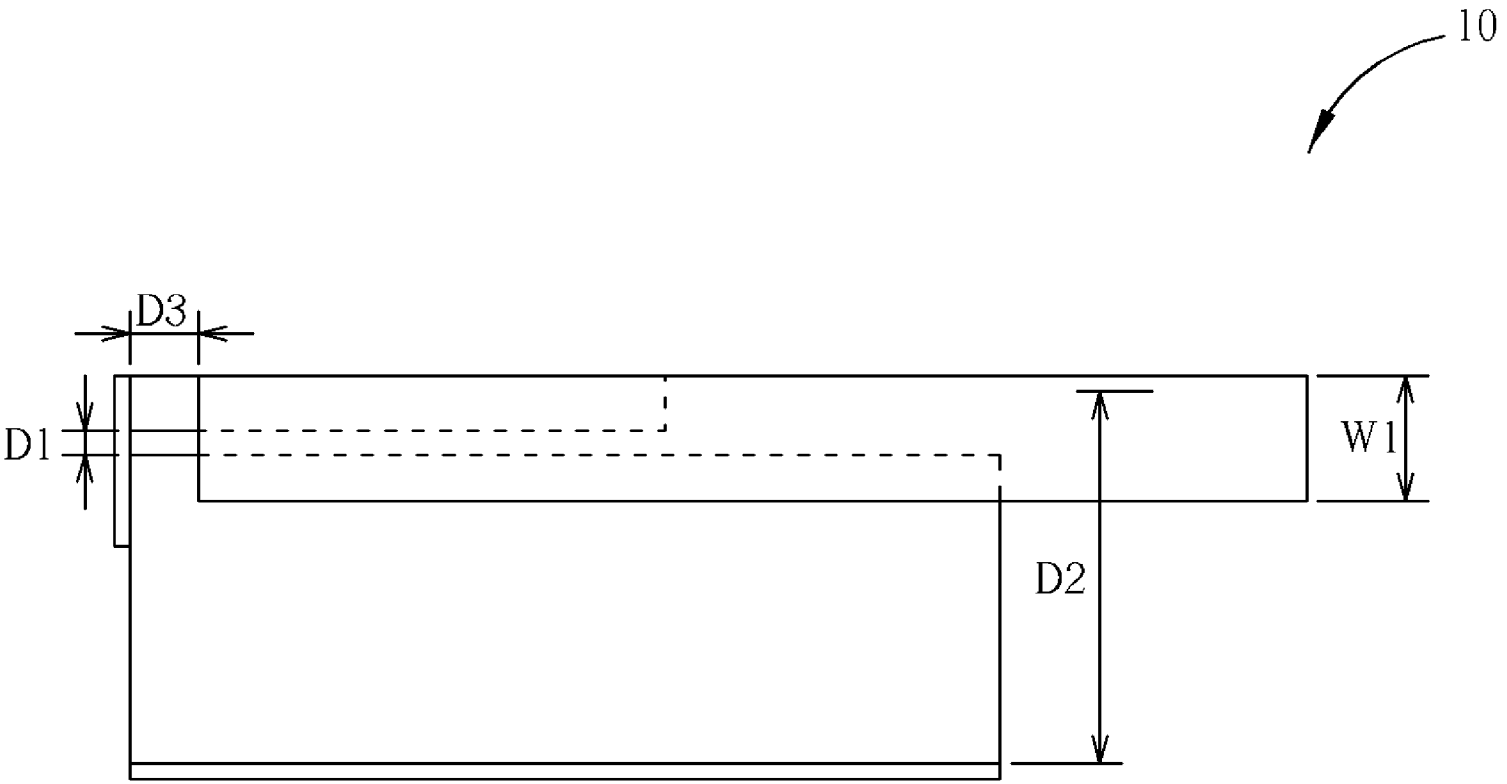
FIG. 2 is a top-view diagram of the multi-frequency antenna in FIG. 1.
Figure 3:
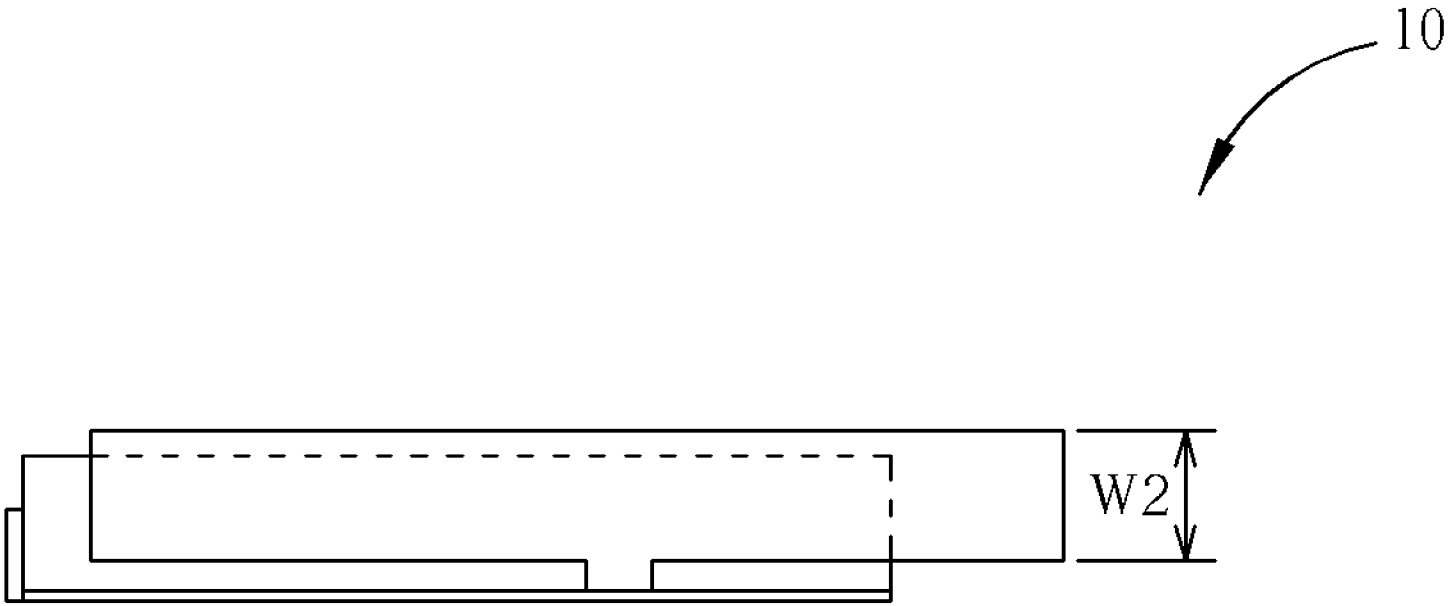
FIG. 3 is a side-view diagram of the multi-frequency antenna in FIG. 1.

Please refer to FIG. 1 to FIG. 3. FIG. 1 is a three-dimensional diagram of a three-dimensional multi-frequency antenna 10 according to an embodiment of the present invention, FIG. 2 is a top-view diagram of the multi-frequency antenna 10 in FIG. 1 (i.e. an XZ plane view), and FIG. 3 is a side-view diagram of the multi-frequency antenna 10 in FIG. 1 (i.e. an XY plane view). The multi-frequency antenna 10 includes a substrate 11, a shorting wall 12, a radiation element 13, a connection element 14 and a feeding terminal 15. The substrate 11 is utilized for electrically connecting to a system ground through a ground terminal 17, and can be bent along a side edge S1 to form a vertical sub substrate 16 for reducing the size of the multi-frequency antenna 10 and enhancing antenna radiation efficiency. The shorting wall 12 is formed vertically along the side edge S1 of the substrate 11, and is utilized for short-circuiting the multi-frequency antenna 10. The radiation element 13 includes a first radiator 131 and a second radiator 132, and is utilized for transmitting and receiving radio signals. The first radiator 131 and the second radiator 132 extends toward opposite directions, and are respectively formed by sheet metals M1 and M2 and sheet metals M3 and M4, among which the sheet metals M1 and M3 are parallel to the XZ plane and the sheet metals M2 and M4 are parallel to the XY plane. The connection element 14 is utilized for connecting the radiation element 13 and the shorting wall 12, and can be formed by bending a long strip of sheet metal M7. One end of the connection element 14 is coupled to the shorting wall 12, and the other end is coupled between the first radiator 131 and the second radiator 132. The connection element 14 and a side edge S2 of the substrate 111 have a spacing interval D1, for avoiding short-circuiting due to the contact of the connection element 14 and the substrate 11, and further for obtaining a desired bandwidth by adjusting the spacing interval D1. Preferably, the spacing interval D1 is substantially between 0.5 mm and 5 mm. The feeding terminal 15 is set between the connection element 14 and the radiation element 13, and is utilized for inputting and outputting signals to and from the multi-frequency antenna 10. In addition, a width of the radiation element 13 (i.e. the sum of a width W1 of the sheet metals M1 and M3 and a width W2 of the sheet metals M2 and M4) and the spacing interval D1 conform to a ratio, and preferably, the ratio is substantially between 1 and 15, with a result that the multi-frequency antenna 10 can meet requirements of a variety of wireless communications networks.

Please note that, the coordinate system as shown in FIG. 1 is merely utilized for clearly illustrating the structure of the multi-frequency antenna of the present invention, but not a limitation of the present invention. For example, the plane formed by the substrate 11 is not necessarily perpendicular to the sheet metals M2 and M4, or the sheet metals M1 and M3 and the sheet metals M2 and M4 are also not necessarily perpendicular to each other. Such corresponding derivatives also belong to the range of the present invention.

Therefore, with the first radiator 131 and second radiator 132, the multi-frequency antenna 10 of the present invention can resonate and generate radio signals of a first resonance frequency band and a second resonance frequency band, respectively. Moreover, the sum of a length of the first radiator 131 and a length of the connection element 14 is substantially corresponding to quarter of a radio signal wavelength of the first resonance frequency band, and the sum of a length of the second radiator 132 and a length of the connection element 14 is substantially corresponding to quarter of a radio signal wavelength of the second resonance frequency band. Besides, with the first radiator 131 and second radiator 132, the multi-frequency antenna 10 can be further utilized for generating radio signals of a frequency-multiplying third resonance frequency band. Thus, by appropriately adjusting dimensions of each part of the multi-frequency antenna 10, such as the ratio of the width of the radiation element 13 and the spacing interval D1, the present invention can obtain sufficient bandwidth for realizing a multi-frequency antenna capable of satisfying all kinds of wireless communications networks.

As well known by those skilled in the art, in order to enhance the antenna bandwidth, the dimensions of the corresponding resonance area of the radiation element are generally increased. However, such doings increases the total area and volume of the antenna as well. Thus, the present invention not only can vary the width W1 of the sheet metals M1 and M3 and the width W2 of the sheet metals M2 and M4 for adjusting the bandwidth, but also can increase the capacitive impedance of the multi-frequency antenna 10 by adjusting the spacing interval D1 between the connection element 14 and the substrate 11 for further enhancing the bandwidth. On the other hand, the radiation element 13 of the present invention formed by the sheet metals M1~M4 can be obtained by bending a single sheet metal, so that the dimensions of the multi-frequency antenna 10 can be reduced for meeting the packed requirements of electronic devices, as well as increasing the antenna bandwidth. Preferably, for enhancing radiation efficiency of the multi-frequency antenna 10, the present invention can further adjust the area of the substrate 11 and the sub substrate 16 by measures like increasing a width W3 of the substrate 11 and a width W4 of the sub substrate 16. Besides, the sub substrate 16 and the sheet metal M2 of the radiation element 13 have a spacing interval D2, the end of the first radiator 131 and the shorting wall 12 have a spacing interval D3, and the multi-frequency antenna 10 can be formed by stamping and cutting a signal sheet metal.

If appropriately adjusting corresponding dimensions of each part of the multi-frequency antenna 10, such as the lengths of the first radiator 131 and the second radiator 132 to be about 15 mm and 20 mm respectively, the widths of the sheet metals M1 and M2 to be about 3 mm, and the spacing interval D1 between the connection element 14 and the substrate 11 to be about 0.7 mm, the center frequency of the first resonance frequency band capable of being resonated and generated by the first radiator 131 is located at about 2 GHz, and the center frequency of the second resonance frequency band capable of being resonated and generated by the second radiator 132 is located at about 3 GHz. In this case, the center frequency of the frequency-multiplying third resonance frequency band generated by the first radiator 131 and the second radiator 132 is located at about 5 GHz.

Figure 4:
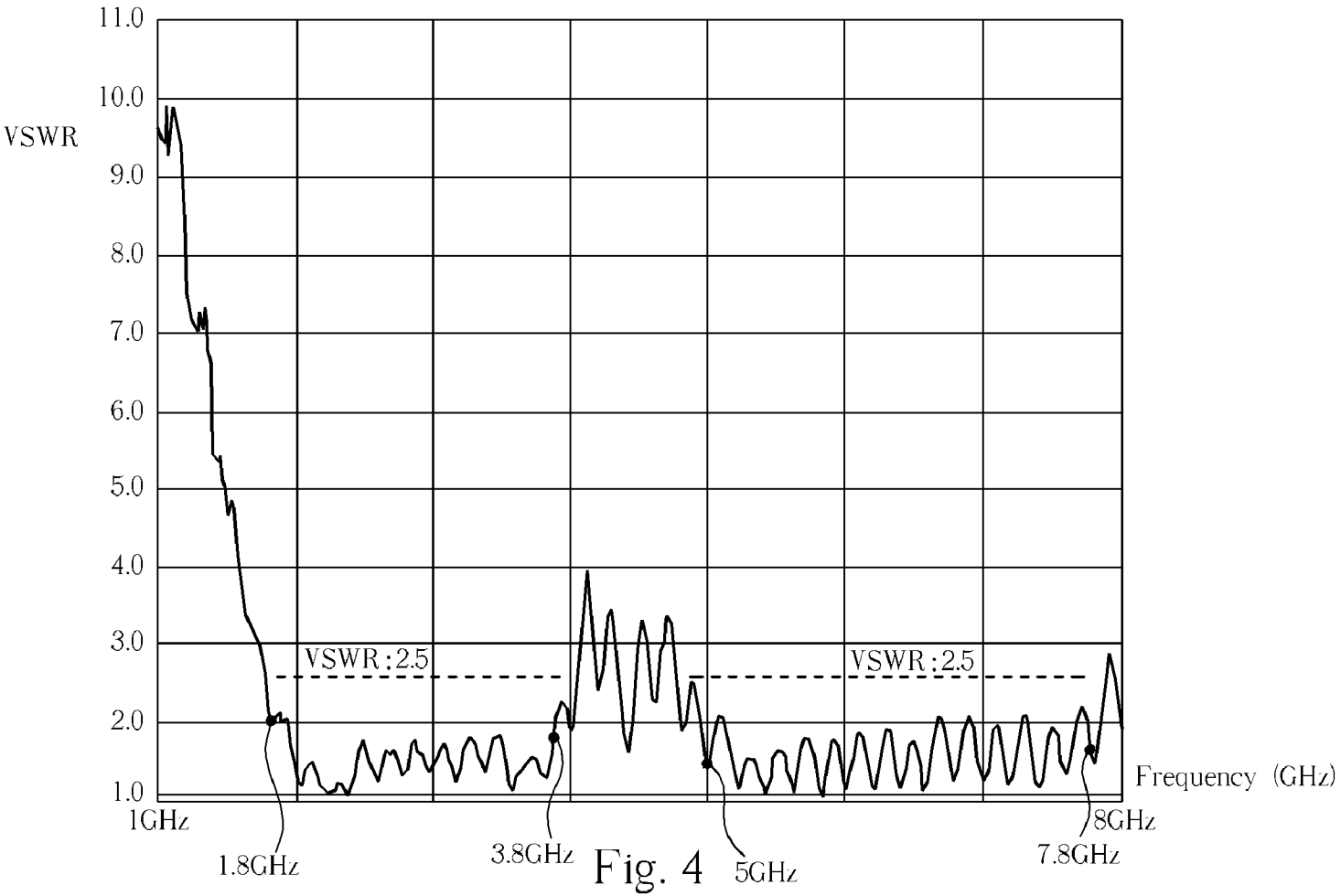
FIG. 4 is a schematic diagram of a voltage standing wave ratio (VSWR) of the multi-frequency antenna according to the present invention.

Please refer to FIG. 4. FIG. 4 is a schematic diagram of a voltage standing wave ratio (VSWR) of the multi-frequency antenna 10 according to the present invention. The horizontal axis represents frequencies (GHz), of which the range lies between 1 GHz and 8 GHz, and the vertical axis represents VSWR. In the case of the VSWR less than 2.5, the first resonance frequency band and the second resonance frequency band of the multi-frequency antenna 10 forms a low frequency band lying between 1.8 GHz and 3.8 GHz, and the third resonance frequency band and its high frequency harmonics form a high frequency band lying between 5 GHz and 7.8 GHz. Therefore, the multi-frequency antenna 10 of the present invention can meet requirements of a variety of wireless communications networks, such as wireless fidelity (Wi-Fi) networks, Bluetooth networks, wideband code division multiple access (WCDMA) networks, global system for mobile communications (GSM) 1900, international mobile telecommunications-2000 (IMT-2000), and so on.

Please further refer to FIG. 5 and FIG. 6. FIG. 5 is a schematic diagram of a radiation pattern of the multi-frequency antenna 10 according to the present invention, and FIG. 6 is a schematic diagram of a measurement result of average gain of the multi-frequency antenna 10 according to the present invention. FIG. 5 and FIG. 6 are XY plane (i.e. $\theta=90°$) measurement results of the multi-frequency antenna 10, of which the frequency range is between 2.3 GHz and 5.875 GHz. As shown in FIG. 5 and FIG. 6, the multi-frequency antenna 10 of the present invention has an omni-directional radiation pattern in XY plane (i.e. the horizontal plane), and the average gain of the multi-frequency antenna 10 can meet requirements of all kinds of wireless communications antennas.

Figure 12:
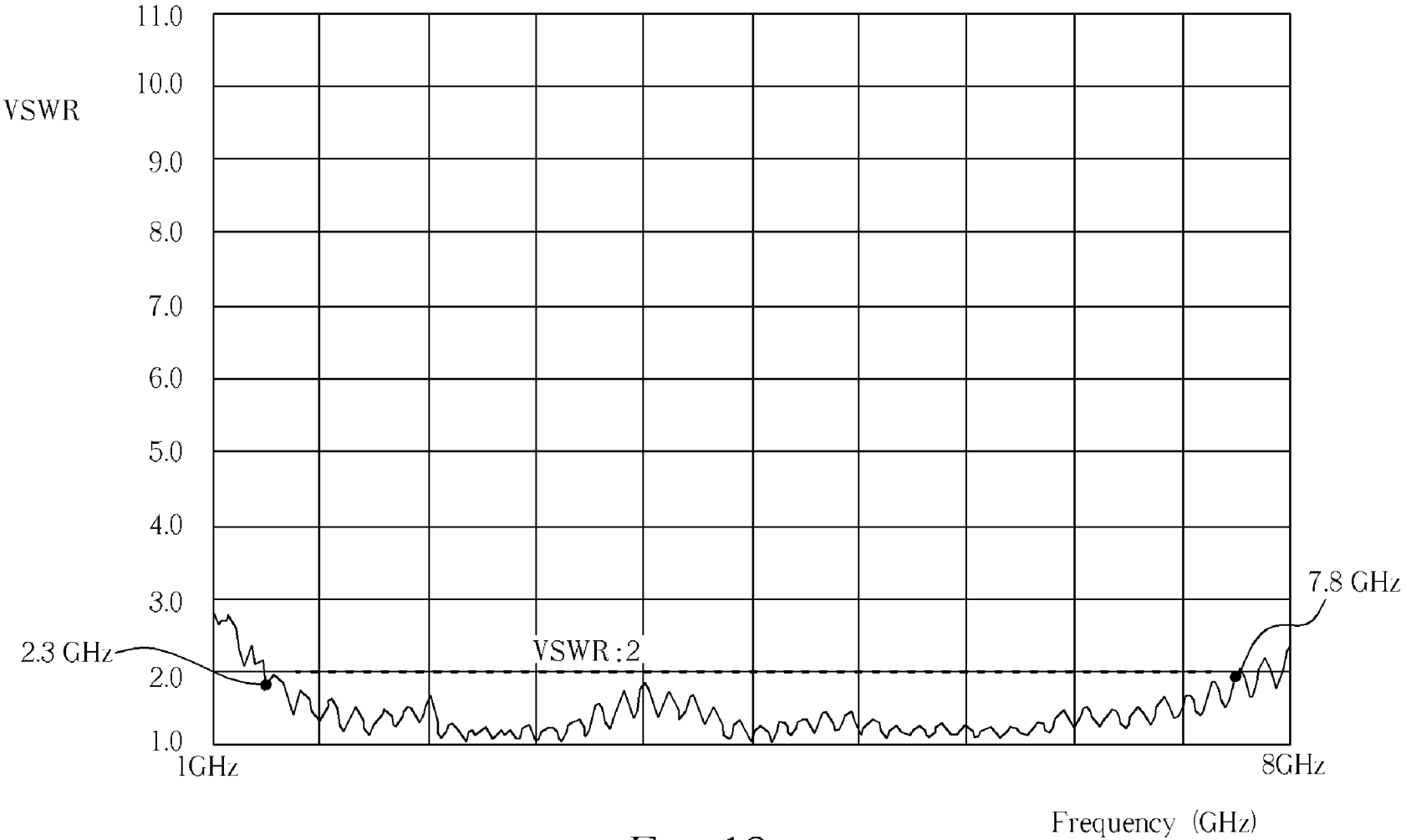
FIG. 12 is a schematic diagram of a voltage standing wave ratio (VSWR) of the multi-frequency antenna according to another embodiment of the present invention.

Besides, by appropriately adjusting the dimensions of the first radiator 131 and the second radiator 132, the present invention can further enhance the bandwidth of the multi-frequency antenna 10. Please refer to FIG. 12. FIG. 12 is a schematic diagram of a voltage standing wave ratio (VSWR) of the multi-frequency antenna according to another embodiment of the present invention. The horizontal axis represents frequencies (GHz), of which the range lies between 2 GHz and 8 GHz, and the vertical axis represents VSWR. In the case of the VSWR less than 2, the frequency band capable of being resonated and generated by the multi-frequency antenna 10 is substantially between 2.3 GHz and 7.8 GHz, so that the multi-frequency antenna 10 of the present invention can further meet requirements of ultra-wideband (UWB) wireless communications technology.

Therefore, the multi-frequency antenna 10 of the present invention can be utilized for receiving and transmitting multi-frequency radio signals and has a good bandwidth performance. Besides, in the present invention, the substrate 11, the shorting wall 12 and the radiation element 13 are bent to form a three-dimensional antenna for effectively reducing the antenna size, and antenna parameters are not thus influenced, so that the omni-directional radiation pattern can still be preserved. Note that, the above-mentioned embodiment is merely an exemplary illustration of the present invention but not a limitation, and those skilled in the art can certainly make appropriate modifications according to practical demands.

Figure 7:
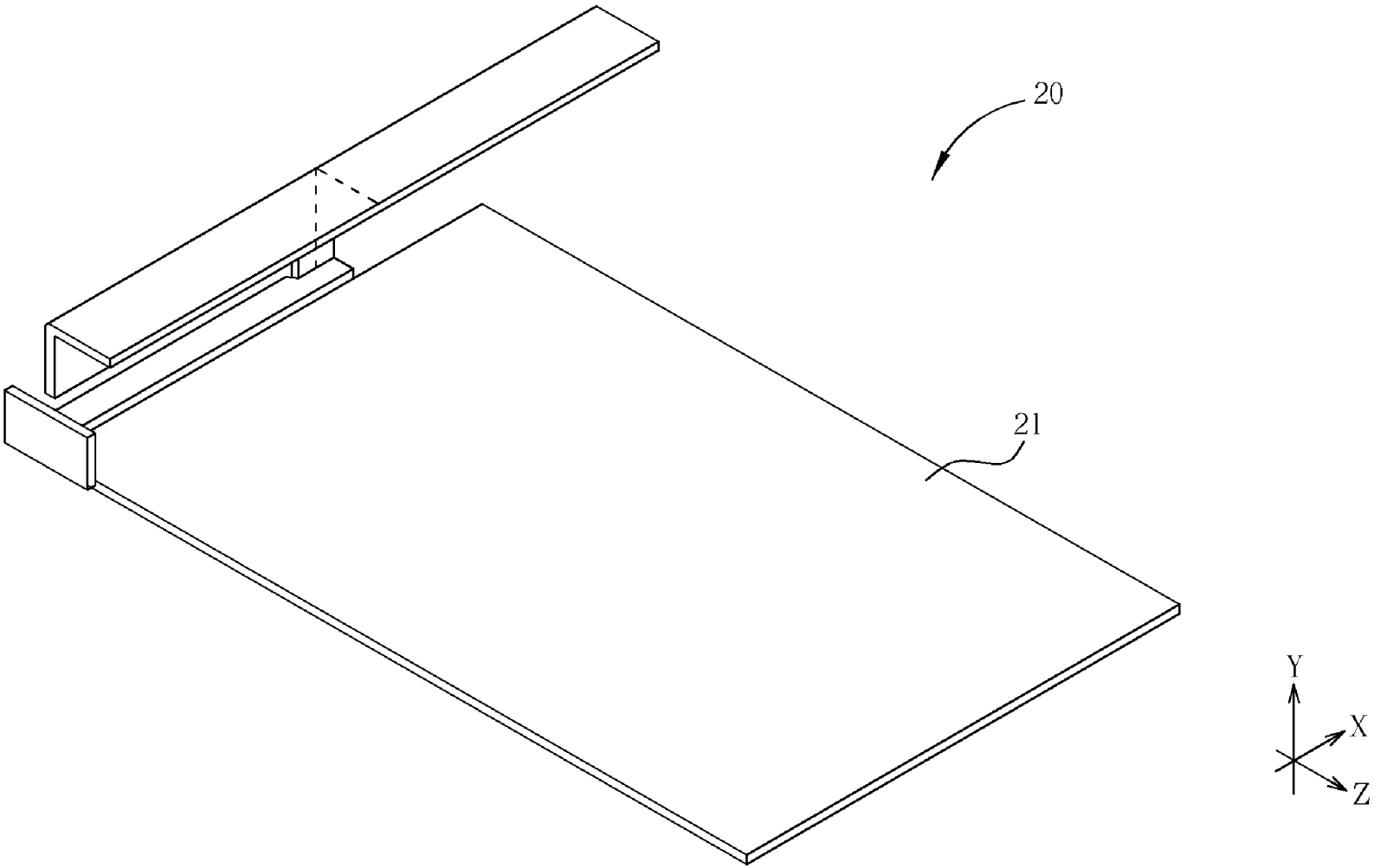
FIG. 7-FIG. 11 are schematic diagrams of three-dimensional multi-frequency antennas according other embodiments of the present invention.
Figure 8:
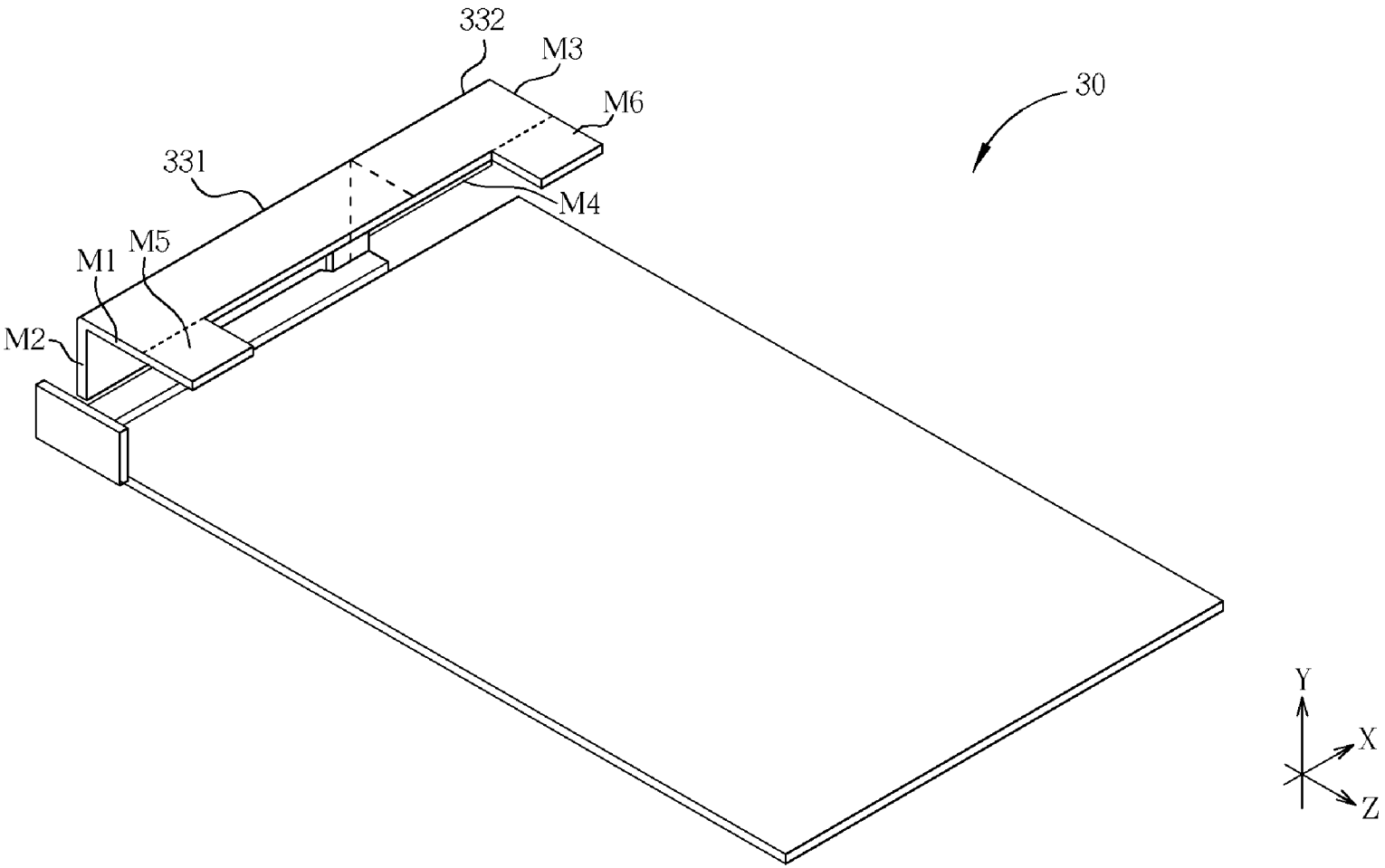
Figure 9:
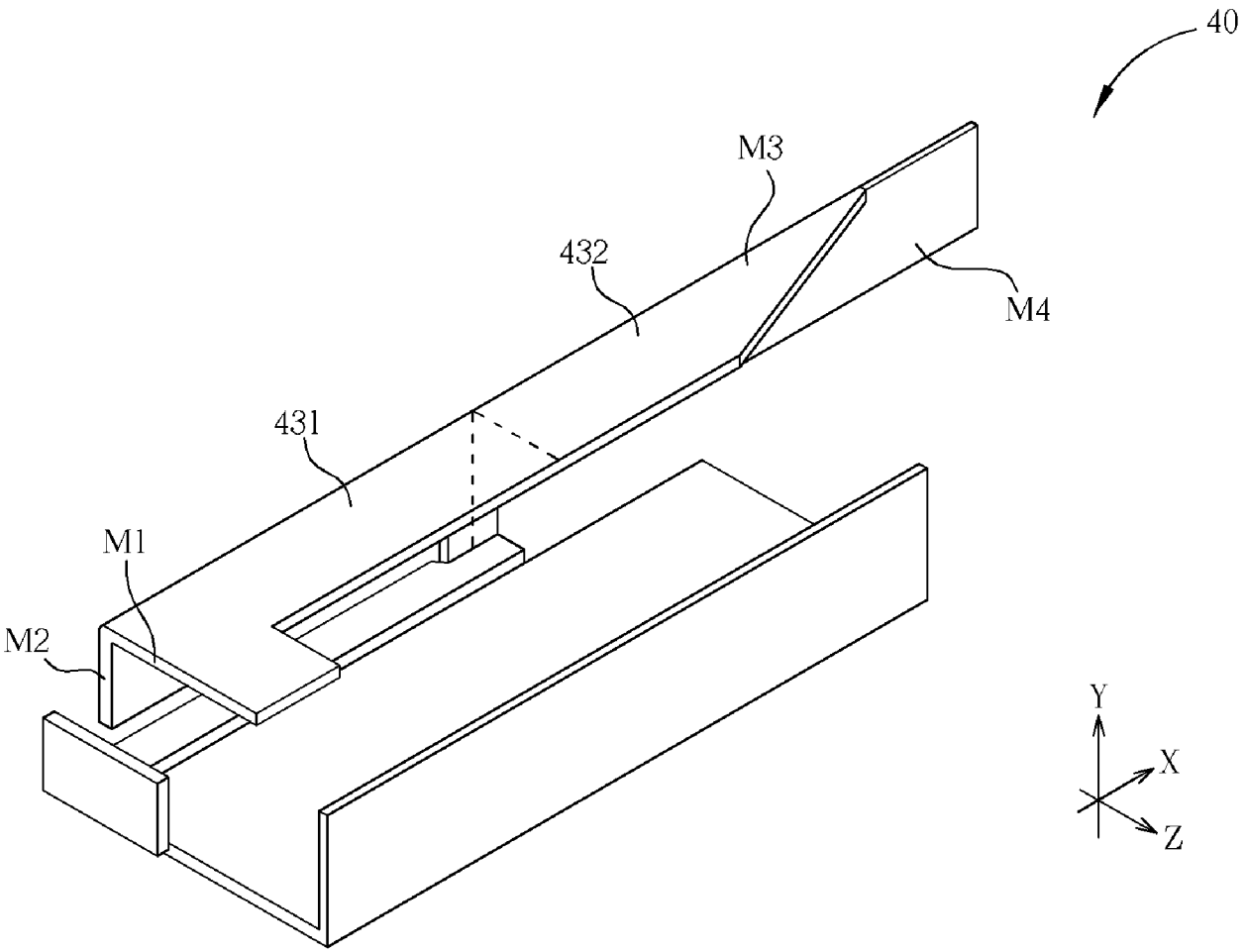

For example, please refer to FIG. 7-FIG. 11. FIG. 7-FIG. 11 are schematic diagrams of three-dimensional multi-frequency antennas according to other embodiments of the present invention. In FIG. 7, a multi-frequency antenna 20 is substantially similar to the multi-frequency antenna 10, and the difference is that, a substrate 21 can be a metal plate, but not including a vertical sub substrate. Besides, the substrate 21 can be directly integrated with a ground plane of a printed circuit board, which also belongs to the range of the present invention. Please refer to FIG. 8, the difference between a multi-frequency antenna 30 and the multi-frequency antenna 10 is that, a first radiator 331 and a second radiator 332 can be further connected with sheet metals M5 and M6, respectively, among which the first radiator 331 and the second radiator 332 can still generate the same first resonance frequency band and the same second resonance frequency band as the first radiator 131 and the second radiator 132 of the multi-frequency antenna 10 does. That means, current paths of the resonance area of the first radiator 331 and the second radiator 332 is as long as that of the first radiator 131 and the second radiator 132. Thus, when reducing the antenna size, the present invention can still keep the same length of the current paths of the radiation element for fitting requirements of mechanism design. Please refer to FIG. 9. In a multi-frequency antenna 40, a first radiator 431 is the same as the first radiator 331 in FIG. 8, and a sheet metal M3 of a second radiator 432 has a corner cut, for fitting requirements of specific electronic devices, such as notebooks.

Figure 10:
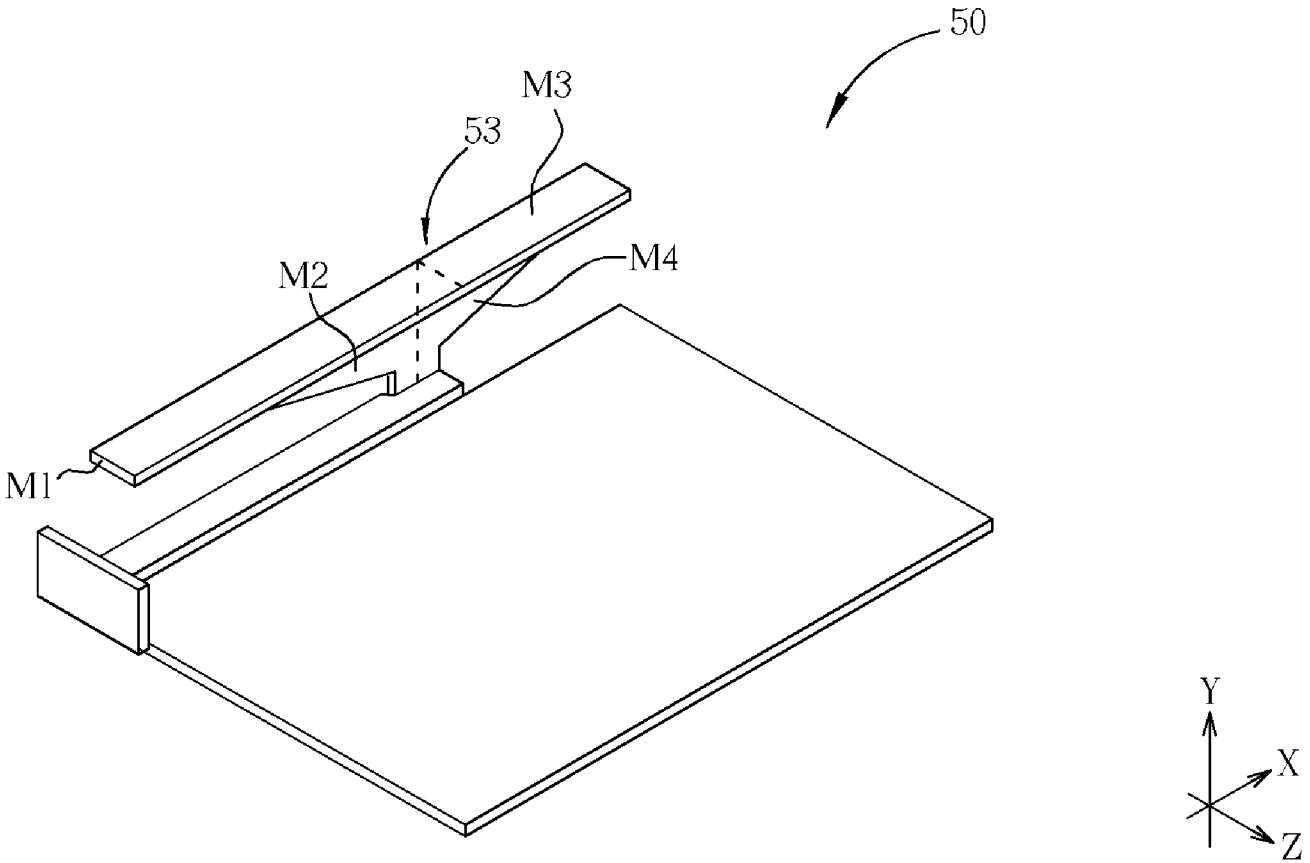
Figure 11:
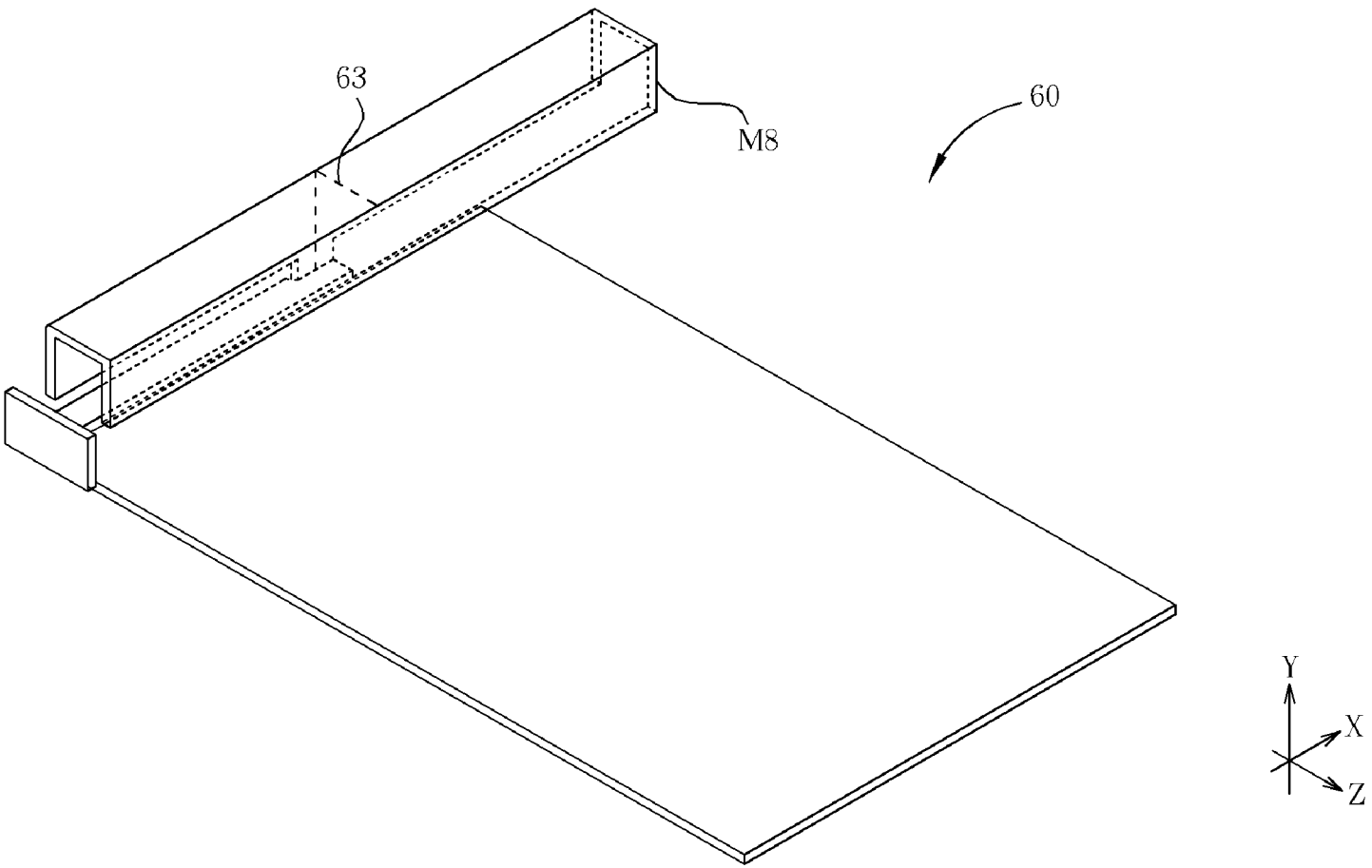

Please refer to FIG. 10. In a multi-frequency antenna 50, a radiation element 53 further has a bow tie structure for enhancing antenna bandwidth, which is well known in this art, and thus is not narrated herein. Finally, please refer to FIG. 11. A multi-frequency antenna 60 can further include a sheet metal M8 perpendicular to sheet metals M1 and M3 on the other edge of a radiation element 63.

As mentioned above, the multi-frequency antenna of the present invention can provide a much wider bandwidth to meet requirements of a variety of different wireless communications networks. In addition, the present invention can perform bending for the substrate, the shorting wall and the radiation element to form a three-dimensional antenna, so that the antenna size can be reduced effectively and the omni-directional radiation pattern can still be preserved as well. Therefore, the multi-frequency antenna of the present invention can be considered as an integration of a Wi-Fi antenna, a WiMax antenna, a Bluetooth antenna, a WCDMA antenna, a GSM 1900 antenna and an IMT2000 antenna.

Those skilled in the art will readily observe that numerous modifications and alterations of the device and method may be made while retaining the teachings of the invention.

What is claimed is:

1. A three-dimensional multi-frequency antenna comprising:

a substrate;

a shorting wall, directly connected to a first edge of the substrate;

a radiation element comprising:

a first radiator having a first sheet metal and a second sheet metal; and a second radiator having a third sheet metal and a fourth sheet metal, the first radiator and the second radiator extending toward opposite directions;

a connection element having a first end directly connected to the shorting wall and a second end opposite to the first end of the connection element;

wherein the connection element is coupled along an edge of the connection element to a second edge of the substrate, and a spacing interval is set between the edge of the connection element and the second edge of the substrate; and a feeding terminal connected between the radiation element and the connection element;

wherein the second end of the connection element is connected at a junction to the feeding terminal and the radiation element.

2. The multi-frequency antenna of claim 1, wherein the connection element is a long strip of sheet metal.

3. The multi-frequency antenna of claim 1, wherein the substrate comprises a sub substrate.

4. The multi-frequency antenna of claim 1, wherein the substrate, the shorting wall and the first sheet metal of the first radiator are perpendicular to each other, and the substrate, the shorting wall and the third sheet metal of the second radiator are perpendicular to each other.

5. The multi-frequency antenna of claim 1, wherein the second sheet metal and the fourth sheet metal have a bow tie structure.

6. The multi-frequency antenna of claim 1, wherein the first radiator further comprises a fifth sheet metal coupled to the first sheet metal, and the second radiator further comprises a sixth sheet metal coupled to the third sheet metal.

7. The multi-frequency antenna of claim 1, wherein the sum of a length of the first radiator and a length of the connection element is corresponding to quarter of a radio signal wavelength of a first resonance frequency band.

8. The multi-frequency antenna of claim 1, wherein the sum of a length of the second radiator and a length of the connection element is corresponding to quarter of a radio signal wavelength of a second resonance frequency band.

9. The multi-frequency antenna of claim 1, wherein the first radiator and the second radiator are further utilized for generating a frequency-multiplying third resonance frequency band.

10. The multi-frequency antenna of claim 1, wherein the spacing interval is substantially between 0.5 mm and 5 mm.

11. The multi-frequency antenna of claim 1, wherein a width of the radiation element and the spacing interval conform to a ratio, and the ratio is substantially between 1 and 15.

12. A three-dimensional multi-frequency antenna comprising:

a substrate formed on a first plane;

a shorting wall formed on a second plane, a side edge of the shorting wall directly connected to a first edge of the substrate;

a radiation element comprising:

a first radiator, corresponding to a first resonance frequency band, having a first sheet metal formed on a third plane and a second sheet metal paralleled with the first plane; and a second radiator, corresponding to a second resonance frequency band, having a third sheet metal formed on the third plane and a fourth sheet metal paralleled with the first plane;

a connection element having a first end directly connected to the side edge of the shorting wall and a second end opposite to the first end of the connection element;

wherein the connection element is coupled along an edge of the connection element to a second edge of the substrate; and a feeding terminal coupled between the radiation element and the connection element;

wherein the second end of the connection element is connected at a junction to the feeding terminal and the radiation element.

13. The multi-frequency antenna of claim 12, wherein the connection a spacing interval is set between the entire edge of the connection element and the second edge of the substrate, and, the spacing interval is substantially between 0.5 mm and 5 mm.

14. The multi-frequency antenna of claim 13, wherein a width of the radiation element and the spacing interval conform to a ratio, the ratio is substantially between 1 and 15.

15. The multi-frequency antenna of claim 12, wherein the first plane, the second plane and the third plane are perpendicular to each other.

16. A three-dimensional multi-frequency antenna comprising:

a substrate;

a shorting wall directly connected to a first edge of the substrate;

a radiation element comprising:

a first radiator comprising at least a bend; and a second radiator comprising at least a bend, the first radiator and the second radiator extending toward opposite directions; and a connection element having a first end directly connected to the shorting wall and a second end opposite to the first end of the connection element;

wherein the connection element is coupled along an edge of the connection element to a second edge of the substrate; and a feeding terminal coupled between the radiation element and the connection element;

wherein the second end of the connection element is connected at a junction to the feeding terminal and the radiation element.

17. The multi-frequency antenna of claim 16 further comprising a feeding terminal coupled between the radiation element and the connection element.

18. The multi-frequency antenna of claim 16, wherein a spacing interval is set between the edge of the connection element and the second edge of the substrate, and the spacing interval is substantially between 0.5 mm and 5 mm.

19. The multi-frequency antenna of claim 18, wherein a width of the first radiator and the spacing interval conform to a ratio, the ratio being substantially between 1 and 15.

20. The multi-frequency antenna of claim 18, wherein a width of the second radiator and the spacing interval conform to a ratio, the ratio being substantially between 1 and 15.

* * * * *